US006322459B1

(12) United States Patent
Nishimura et al.

(10) Patent No.: US 6,322,459 B1
(45) Date of Patent: Nov. 27, 2001

(54) GOLF CLUB HEAD

(75) Inventors: Toshinori Nishimura; Masahiko Miyamoto, both of Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 09/460,402

(22) Filed: Dec. 13, 1999

(30) Foreign Application Priority Data

Dec. 14, 1998 (JP) ..... 10-355037

(51) Int. Cl.[7] ..... A63B 53/04
(52) U.S. Cl. ..... 473/330; 473/331; 473/345
(58) Field of Search ..... 473/324, 330, 473/331, 350, 342, 287, 290, 346, 345

(56) References Cited

U.S. PATENT DOCUMENTS 4,508,349 * 4/1985 Gebauer .
4,550,914 * 11/1985 McCallister .
4,792,140 * 12/1988 Yamaguchi .
5,090,702 * 2/1992 Viste .
5,591,092 * 1/1997 Gilbert .
5,601,501 * 2/1997 Kobayashi .
5,611,742 * 3/1997 Kobayashi .
5,676,605 * 10/1997 Kobayashi .
5,688,186 * 11/1997 Michaels .
5,711,722 * 1/1998 Miyajima .
5,735,755 * 4/1998 Kobayashi .
5,755,626 * 5/1998 Shira .
5,762,566 * 6/1998 King .
5,766,087 * 6/1998 Kawamatsu .

* cited by examiner

*Primary Examiner*—Sebastiano Passaniti
(74) *Attorney, Agent, or Firm*—Finnegan, Henderson, Farabow, Garrett & Dunner, L.L.P.

(57) ABSTRACT

A golf club head is disclosed, which comprises a hollow structure composed of a face portion constituting a ball hitting face, a crown portion and a sole portion each provided successively from the face portion, and a plurality of grooves provided in the face portion. Depths of the grooves are gradually changed in accordance with a position of the face portion.

7 Claims, 9 Drawing Sheets

GOLF CLUB HEAD

BACKGROUND OF THE INVENTION

The present invention relates to a golf club head having a hollow structure. More specifically, the invention relates to a golf club head capable of setting an optional spin characteristic of a ball without giving any substantial effects on a center of gravity or a total weight, and thereby satisfying a request made by a golfer.

The golf club head generates rotation around its center of gravity when it hits a ball by a portion shifted from a sweet spot, and then gives a spin to the ball. This spin generating mechanism is generally called a gear effect. For example, in a conventional head structure, because of the gear effect, the quantity of backspin is reduced more for a ball hit by a head upper portion compared with a ball hit by a center portion. The quantity of backspin is increased more for a ball hit by a head lower portion compared with a ball hit by a center portion. In the case of a ball hit by a head toe portion, hook rotation (left rotation) is generated and, in the case of a ball hit by a heel portion, slice rotation (right rotation) is generated. In addition, it is generally known that the gear effect is increased as a thickness of a face portion is thinner, and the gear effect is reduced as a thickness thereof is thicker.

Thus, to control a spin characteristic of a ball, efforts have been made to reduce the gear effect by changing the thickness of the face portion to change its rigidity. However, the changed thickness of the face portion resulted not only in the change in the rigidity of the face portion but also in the change in the center of gravity or total weight of the golf club head. Moreover, the changed thickness of the face portion resulted in the complexity of designing a core used for molding. Consequently, thickness accuracy was difficult to obtain, and a molten metal flow failure and other manufacturing difficulties easily occurred. The changed thickness also caused inconveniences such as a deteriorated hitting sound as a golf club head.

SUMMARY OF THE INVENTION

It is an object of the present invention to provide a golf club head capable of setting an optional spin characteristic of a ball without giving any substantial effects on a center of gravity or a total weight.

In order to achieve the above object, a golf club head of the present invention comprises: a hollow structure composed of a face portion constituting a ball hitting face, a crown portion and a sole portion each provided successively from the face portion; and a plurality of grooves provided in the face portion. Depths of the grooves are gradually changed in accordance with a position of the face portion. More specifically, depths of the grooves are set larger in a position for reducing rigidity of the face portion more.

As described above, the plurality of grooves are provided in the face portion of the golf club head, and depths of the grooves are gradually changed in accordance with a position of the face portion. Accordingly, only rigidity of the face can be changed while keeping constant a thickness of the face portion or without changing a thickness of the same. Thus, a ball spin characteristic can be optionally set without any substantial effects given on a center of gravity or a total weight. With this constitution, various requests made by golfers can be satisfied without any great designing changes for the golf club head.

Furthermore, since it is not necessary to change a thickness of the face portion, designing of a core used during molding can be simplified, and thickness accuracy can be increased. Accordingly, inconveniences such as a molten metal flow failure or the like can be prevented. Moreover, since it is not necessary to change a thickness of the face portion, good hitting sound as a golf club head can be maintained.

Regarding the plurality of grooves, score lines provided in an outer surface of the face portion can be utilized. In particular, according to the present invention, since depths of the grooves are changed in accordance with a position of the face portion, rigidity of the face portion can be adjusted without changing the appearance of the score lines at all. But these grooves may be provided in an inner surface of the face portion.

BRIEF DESCRIPTION OF THE DRAWINGS

FIG. 1(*b*) is a sectional view taken on line X—X of FIG. 1(*a*).

FIG. 1(*c*) is a sectional view taken on line Y—Y of FIG. 1(*a*).

FIG. 2(*b*) is a sectional view taken on line X—X of FIG. 2(*a*).

FIG. 2(*c*) is a sectional view taken on line Y—Y of FIG. 2(*a*).

FIG. 3(*b*) is a sectional view taken on line X—X of FIG. 3(*a*).

FIG. 3(*c*) is a sectional view take on line Y—Y of FIG. 3(*a*).

FIG. 4(*b*) is a sectional view taken on line X—X of FIG. 4(*a*).

FIG. 4(*c*) is a sectional view taken on line Y—Y of FIG. 4(*a*).

FIG. 5(*b*) is a sectional view taken on line X—X of FIG. 5(*a*).

FIG. 5(*c*) is a sectional view taken on line Y—Y of FIG. 5(*a*).

FIG. 6(*b*) is a sectional view taken on line X—X of FIG. 6(*a*).

FIG. 6(*c*) is a sectional view taken on line Y—Y of FIG. 6(*a*).

FIG. 7(*b*) is a sectional view taken on line X—X of FIG. 7(*a*).

FIG. 7(*c*) is a sectional view taken on line Y—Y of FIG. 7(*a*).

FIG. 8(*b*) is a sectional view taken on line X—X of FIG. 8(*a*).

FIG. 8(*c*) is a sectional view taken on line Y—Y of FIG. 8(*a*).

DETAILED DESCRIPTION OF THE PREFERRED EMBODIMENTS

Figure 1A:
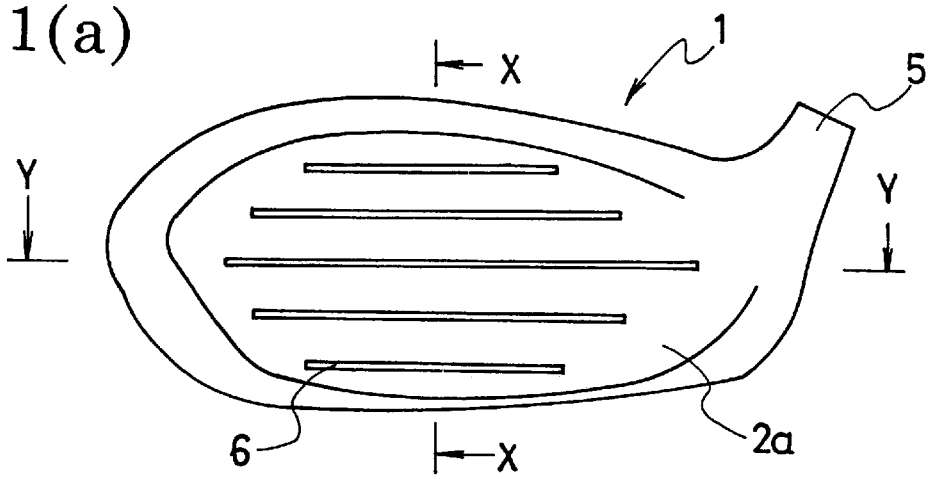
FIG. 1(*a*) is a front view showing a golf club head according to a first example of the present invention.
Figure 1B:
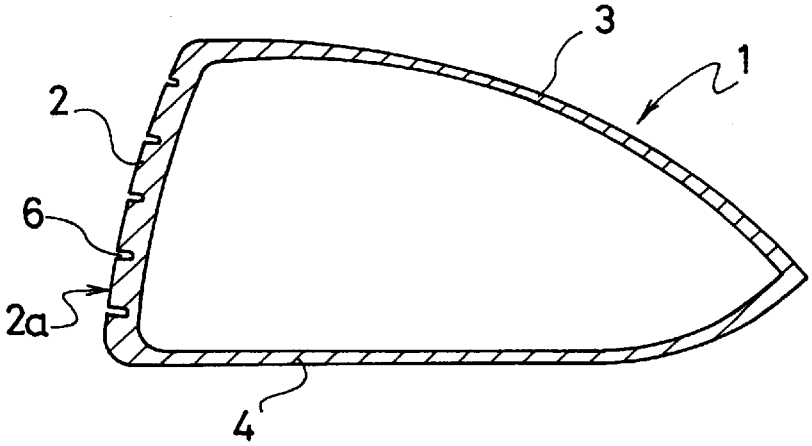
Figure 1C:
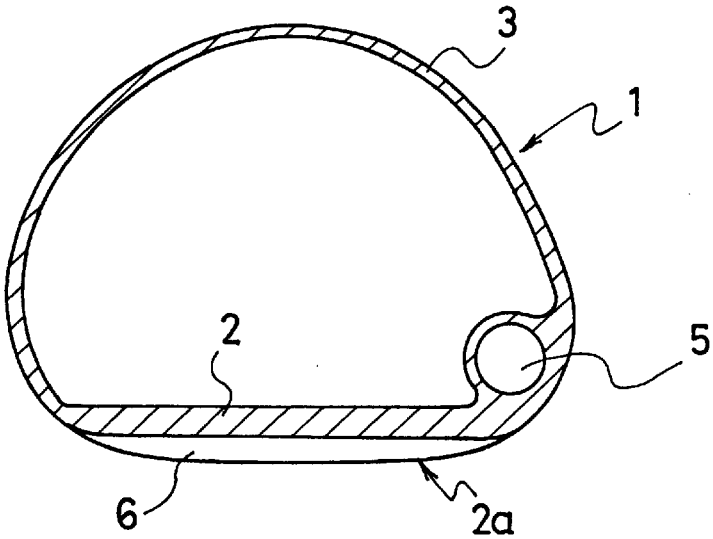

FIGS. 1(*a*) to 1(*c*) are views, each of which shows a golf club head according to a first example of the present invention. In the drawing, a golf club head 1 has a hollow structure, which is composed of a face portion 2 constituting a ball hitting face, a crown portion 3 constituting a head upper shell, and a sole portion 4 constituting a head bottom plate. The face, crown and sole portions 2, 3 and 4 are respectively made of metals such as titanium, stainless steel, aluminum or the like. The golf club head 1 includes a cylindrical hosel portion 5 formed to be united in the heel side. A shaft is joined through this hosel portion 5.

An outer surface 2*a* of the face portion 2 includes a plurality of grooves 6 to be extended in a toe and heel direction of the golf club head 1. These grooves 6 form score lines. The score lines may be continuously extended along the outer surface 2*a* of the face portion 2. Alternatively, the score lines may have intermittent designs including dimples.

According to the first example, a thickness of the face portion 2 is roughly uniform. But rigidity of the face portion 2 is gradually reduced from the head upper portion to the lower portion by setting depths of the plurality of grooves 6 to be gradually increased from the head upper portion to the lower portion.

With the foregoing constitution, since a gear effect is smaller for a ball hit by the head upper portion, the quantity of backspin is increased compared with the conventional case. On the other hand, since a gear effect is larger for a ball hit by the head lower portion, the quantity of backspin is increased compared with the conventional case. The first example thus provides a structure capable of increasing the quantity of backspin as a whole. Accordingly, the golf club head is suited mainly for a golfer of a slow head speed. The golf club head can also be used suitably by a golfer of an average head speed on rainy days.

Figure 2A:
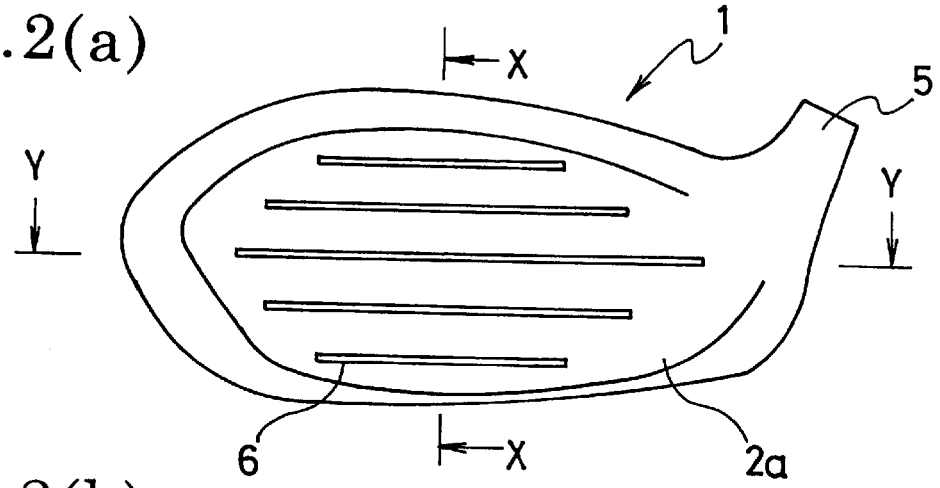
FIG. 2(*a*) is a front view showing a golf club head according to a second example of the invention.
Figure 2B:
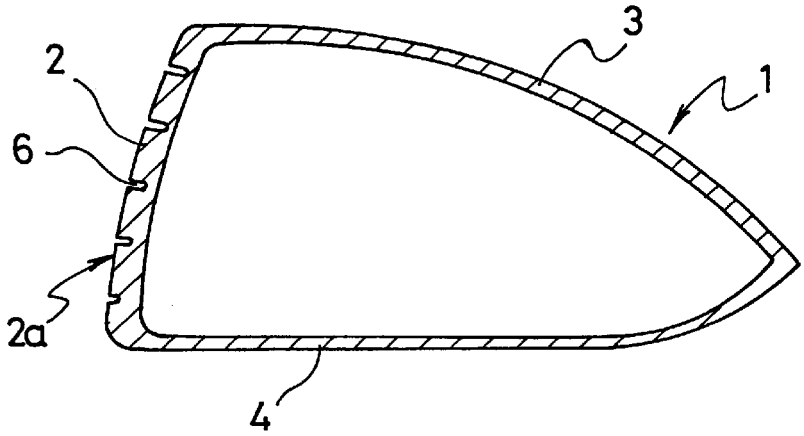
Figure 2C:
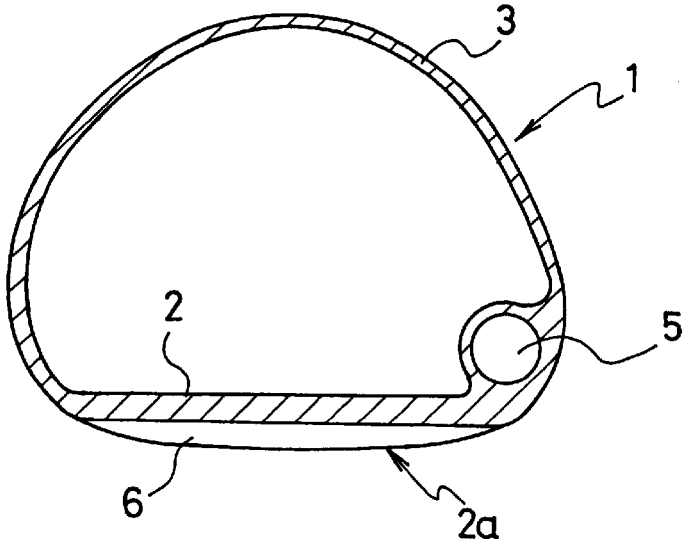

FIGS. 2(*a*) to 2(*c*) are views, each of which shows a golf club head according to a second example of the invention. According to the second example, a thickness of the face portion 2 is roughly uniform. But rigidity of the face portion 2 is gradually reduced from the head lower portion to the head upper portion by setting depths of the plurality of grooves 6 to be gradually increased from the head lower portion to the upper portion.

With the foregoing constitution, since a gear effect is larger for ball hit by the head upper portion, the quantity of backspin is reduced in a relative relation to the same. On the other hand, since a gear effect is smaller for a ball hit by the head lower portion, the quantity of backspin is reduced in a relative relation to the same. The second example thus provides a structure capable of reducing the quantity of backspin as a whole. Accordingly, the golf head club is suited mainly for a golfer of a fast head speed. The golf club head can also be used suitably by a golfer of an average head speed on windy days.

Figure 3A:
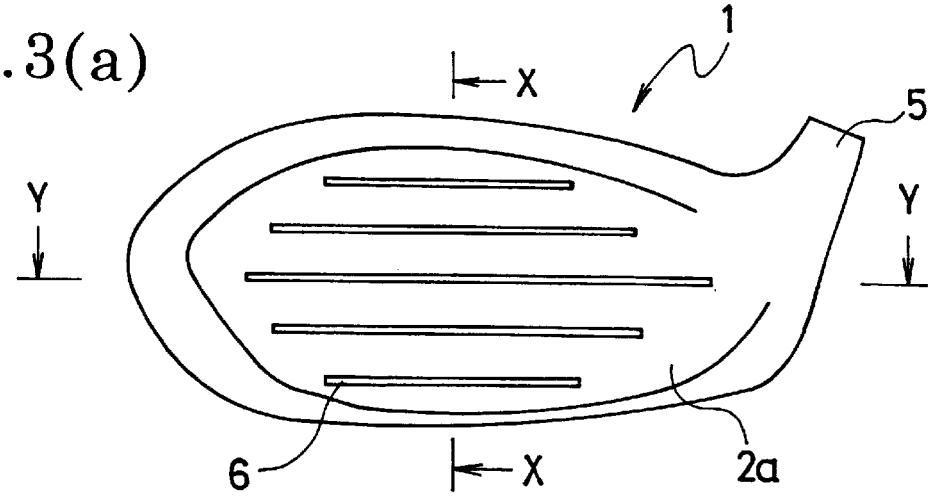
FIG. 3(*a*) is a front view showing a golf club head according to a third example of the invention.
Figure 3B:
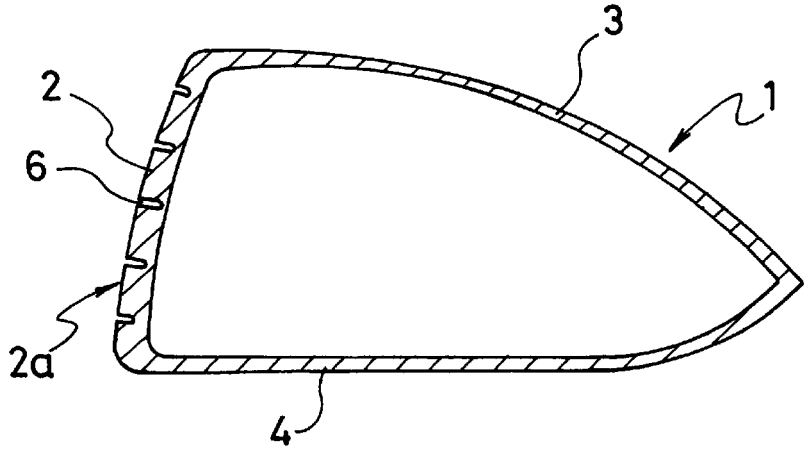
Figure 3C:
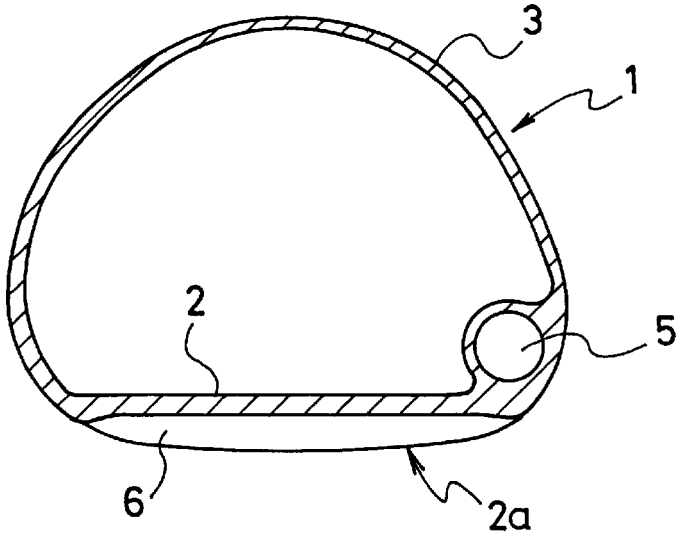

FIGS. 3(*a*) to 3(*c*) are views, each of which shows a golf club head according to a third example of the invention. According to the third example, a thickness of the face portion 2 is roughly uniform. But rigidity of the face portion 2 is gradually reduced from both the upper and lower ends to the center portion by setting depths of the plurality of grooves 6 to be gradually increased from both the upper and lower ends to the center portion.

With the foregoing constitution, since a gear effect is smaller for a ball hit by the head upper portion, the quantity of backspin is increased in a relative relation to the same. On the other hand, since a gear effect is smaller for a ball hit by the head lower portion, the quantity of backspin is reduced in a relative relation to the same. The third example thus provides a structure capable of reducing difference in the quantities of spin between the upper and lower hitting points. Accordingly, the golf club head is suited for a golfer wishing to prevent a change in trajectory caused by variance in the upper and lower hitting points.

Figure 4A:
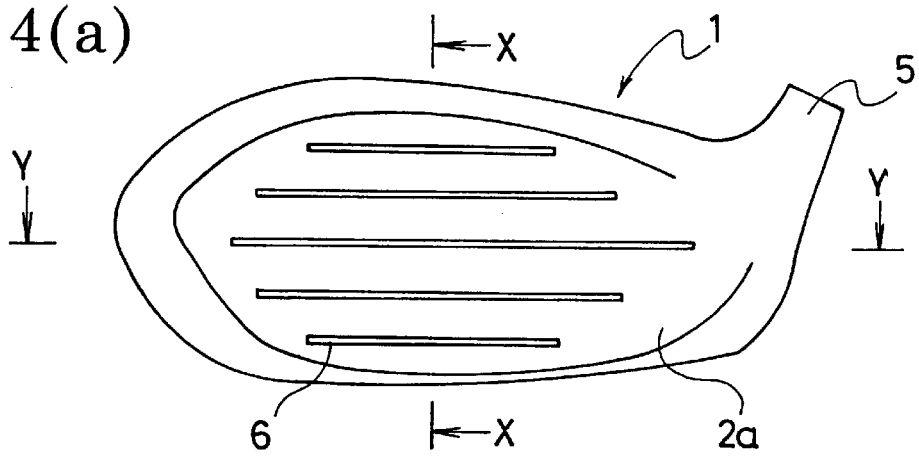
FIG. 4(*a*) is a front view showing a golf club head according to a fourth example of the invention.
Figure 4B:
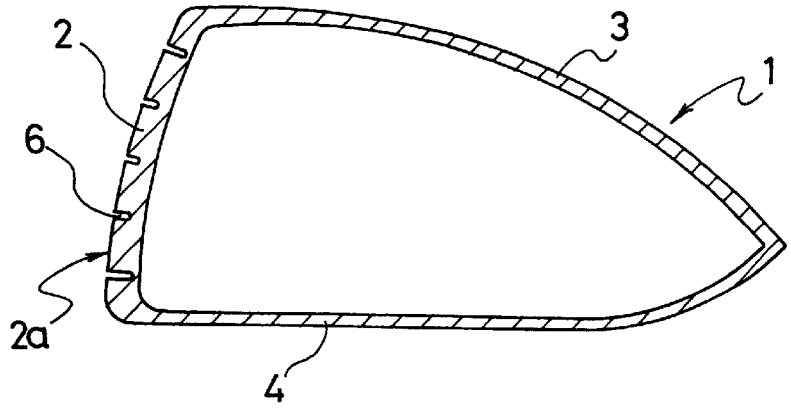
Figure 4C:
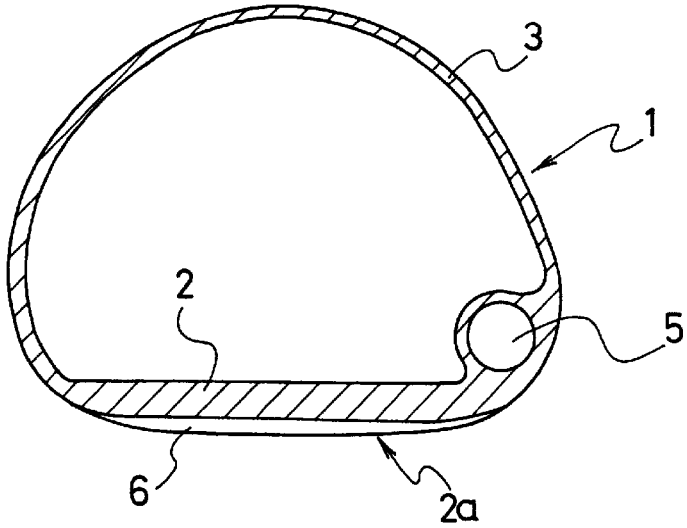

FIGS. 4(*a*) to 4(*c*) are views, each of which shows a golf club head according to a fourth example of the invention. According to the fourth example, a thickness of the face portion 2 is roughly uniform. But rigidity of the face portion 2 is gradually reduced from the center portion to both the upper and lower ends by setting depths of the plurality of grooves 6 to be gradually increased from the center portion to both the upper and lower ends.

With the foregoing constitution, since a gear effect is larger for a ball hit by the head upper portion, the quantity of backspin is reduced in a relative relation to the same. On the other hand, since a gear effect is larger for a ball hit by the head lower portion, the quantity of backspin is increased in a relative relation to the same. The fourth example thus provides a structure capable of increasing difference in the quantities of spin between the upper and lower hitting points. Accordingly, the golf club head is suited for a golfer wishing to control a ball by alternately using the upper and lower hitting points so as to change trajectory.

Figure 5A:
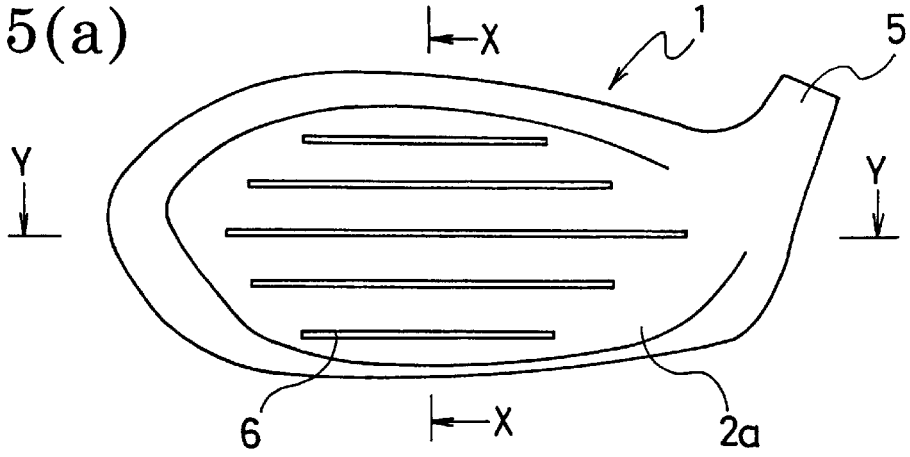
FIG. 5(*a*) is a front view showing a golf club head according to a fifth example of the invention.
Figure 5B:
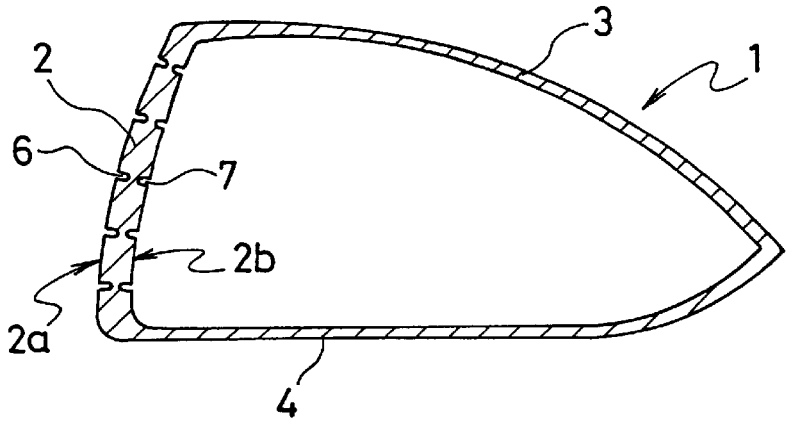
Figure 5C:
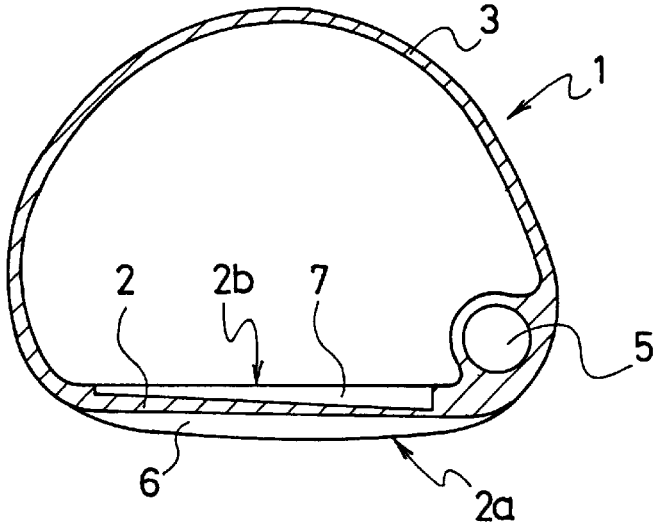

FIGS. 5(*a*) to 5(*c*) are views, each of which shows a golf club head (for right-handed) according to a fifth example of the invention. In the drawing, the inner surface 2*b* of the face portion 2 includes a plurality of grooves 7 formed to be extended in a toe and heel direction of the golf club head 1. The outer surface 2*a* of the face portion 2 includes a score line composed of the plurality of grooves 6, which are extended in the toe and heel direction of the golf club head 1. In this case, depths of the grooves 6 constituting the score line are uniform on the entire face portion 2.

According to the fifth example, a thickness of the face portion 2 is roughly uniform. But rigidity of the face portion 2 is gradually reduced from the head toe portion to the heel portion by setting depths of the plurality of grooves 7 to be gradually increased from the head toe portion to the heel portion.

With the foregoing constitution, since a gear effect is smaller for a ball hit by the head toe portion, hook rotation is reduced in a relative relation to the same. On the other hand, since a gear effect is larger for a ball hit by the heel portion, slice rotation is increased in a relative relation to the same. The fifth example thus provides a structure capable of increasing a slice tendency as a whole. Accordingly, the golf club head is suited mainly for a golfer of a hook ball. The golf club head can also be used by a golfer trying to hit a slice ball.

Figure 6A:
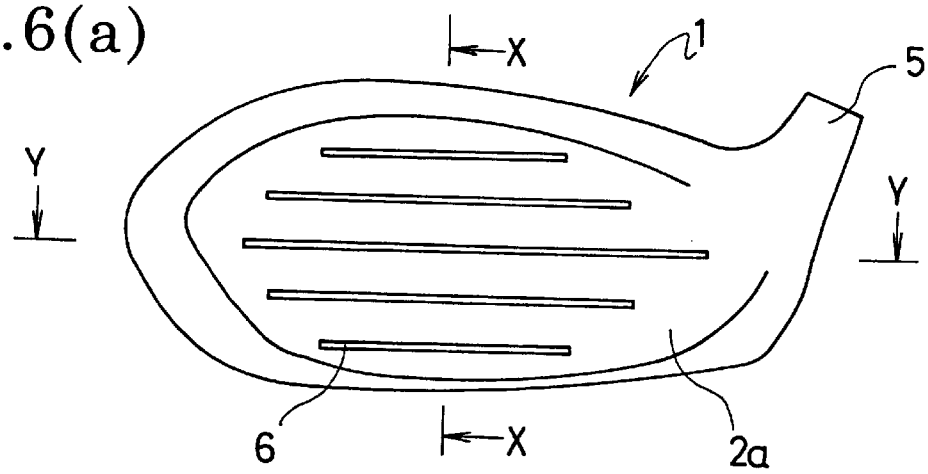
FIG. 6(*a*) is a front view showing a golf club head according to a sixth example of the invention.
Figure 6B:
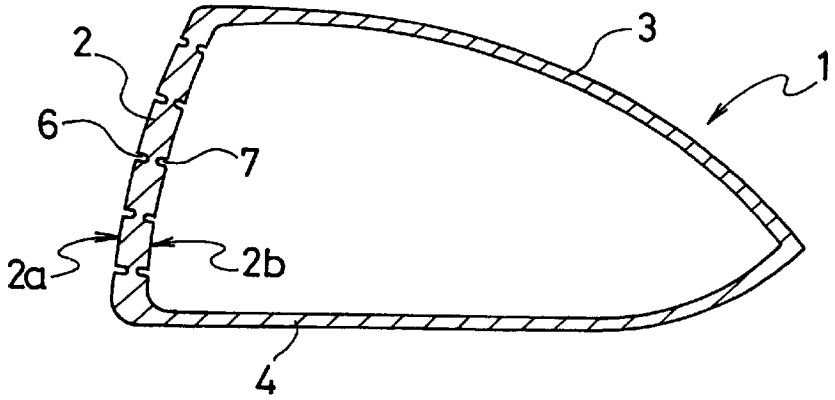
Figure 6C:
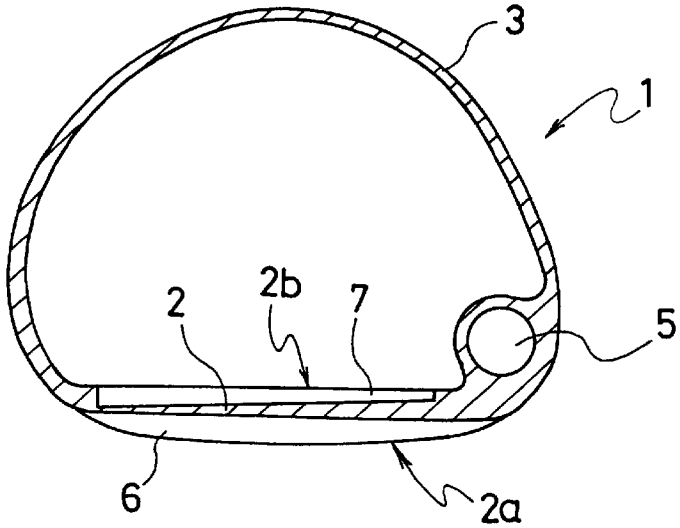

FIGS. 6(*a*) to 6(*c*) are views, each of which shows a golf club head (for right-handed) according to a sixth example of the invention. According to the sixth example, a thickness of the face portion 2 is roughly uniform. But rigidity of the face portion 2 is gradually reduced from the head heel portion to the toe portion by setting depths of the plurality of grooves 7 to be gradually increased from the head heel portion to the toe portion.

With the foregoing constitution, since a gear effect is larger for a ball hit by the head toe portion, hook rotation is increased in a relative relation to the same. On the other hand, since a gear effect is smaller for a ball hit by the heel portion, slice rotation is reduced in a relative relation to the same. The sixth example thus provides a structure capable of increasing a hook tendency as a whole. Accordingly, the golf club head is suited mainly for a golfer of a slice ball. The golf club head can also be used by a golfer trying to hit a hook ball.

Figure 7A:
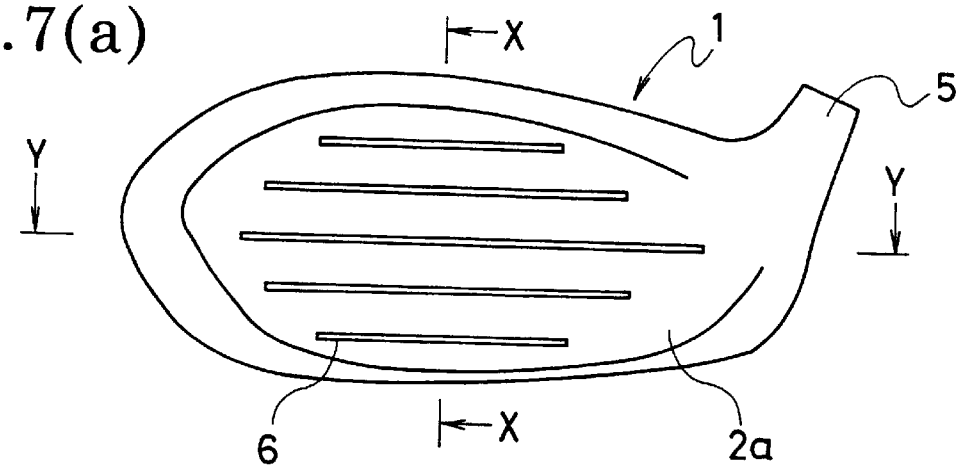
FIG. 7(*a*) is a front view showing a golf club head according to a seventh example of the invention.
Figure 7B:
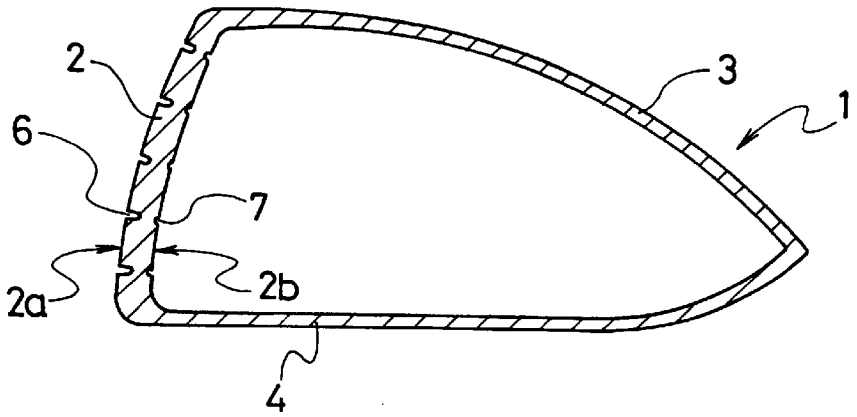
Figure 7C:
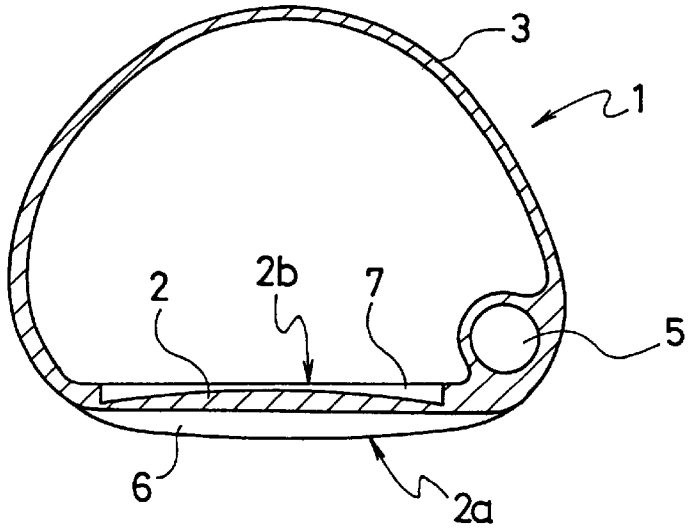

FIGS. 7(*a*) to 7(*c*) are views, each of which shows a golf club head (for right-handed) according to a seventh example of the invention. According to the seventh example, a thickness of the face portion 2 is roughly uniform. But rigidity of the face portion 2 is gradually reduced from the center portion to both the toe and heel ends by setting depths of the plurality of grooves 7 to be gradually increased from the center portion to both the toe and heel ends.

With the foregoing constitution, since a gear effect is larger for a ball hit by the head toe portion, hook rotation is increased in a relative relation to the same. On the other hand, since a gear effect is larger for a ball hit by the heel portion, slice rotation is increased in a relative relation to the same. The seventh example thus provides a structure capable of increasing effects by the hook and slice rotations in the left and right (toe and heel direction) hitting points. Accordingly, the golf club head is suited for a golfer wishing to control a ball by alternately using the left and right hitting points to change a trajectory.

Figure 8A:
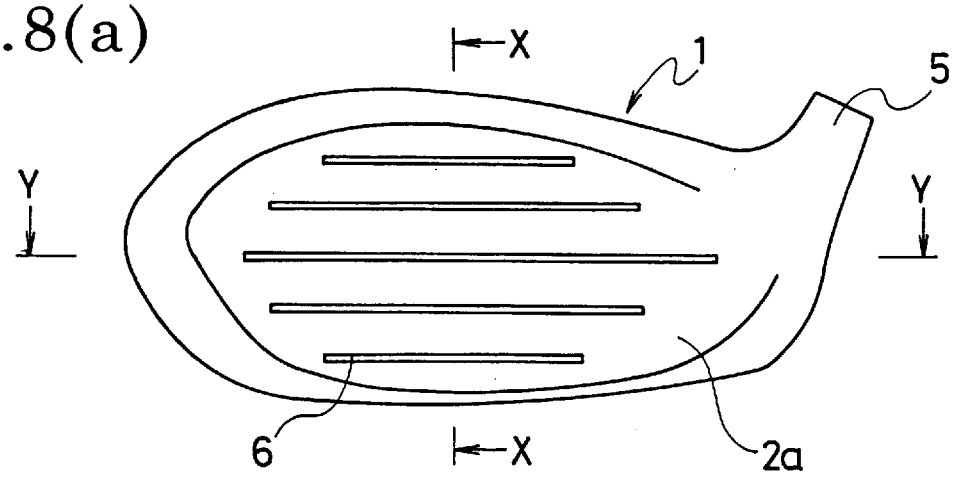
FIG. 8(*a*) is a front view showing a golf club head according to an eighth example of the invention.
Figure 8B:
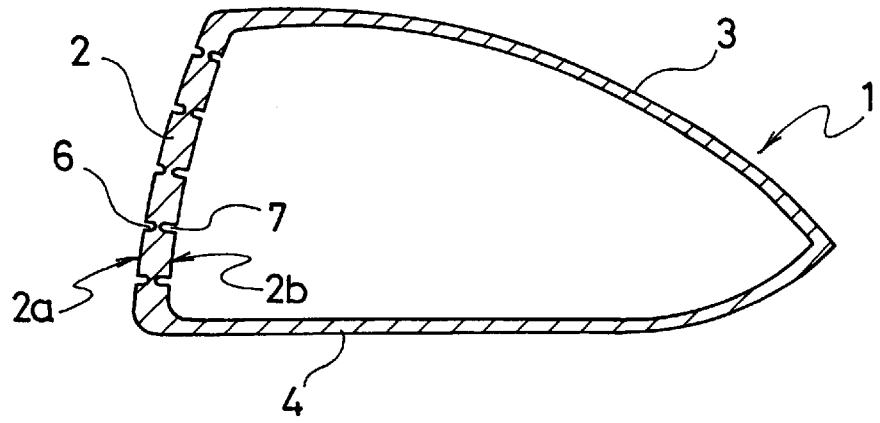
Figure 8C:
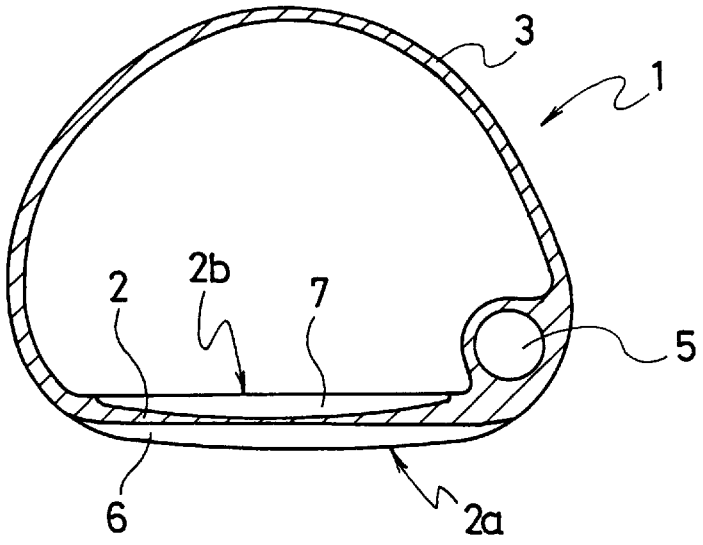

FIGS. 8(*a*) to 8(*c*) are views, each of which shows a golf club head (for right-handed) according to an eighth example of the invention. According to the eighth example, a thickness of the face portion 2 is roughly uniform. But rigidity of the face portion 2 is gradually reduced from both the toe and heel ends to the center portion by setting depths of the plurality of grooves 7 to be gradually increased from both the toe and heel ends to the center portion.

With the foregoing constitution, since a gear effect is smaller for a ball hit by the head toe portion, hook rotation is reduced in a relative relation to the same. On the other hand, since a gear effect is smaller for a ball hit by the heel portion, slice rotation is reduced in a relative relation to the same. The eighth example thus provides a structure capable of reducing effects by the hook and slice rotations in the left and right (toe and heel direction) hitting points. Accordingly, the golf club head is suited for a golfer wishing to prevent a change in trajectory caused by variance in the left and right hitting points.

According to the present invention, the pluralities of grooves 6 and 7 are provided in the face portion 2 of the golf club head 1, and the depths of the grooves 6 and 7 are gradually changed in accordance with the position of the face portion 2. Accordingly, only rigidity of the face portion 2 can be changed while keeping uniform the thickness of the face portion 2 or without changing the thickness of the face portion 2. Therefore, the changed rigidity of the face portion 2 can be prevented from giving any substantial effects on a center of gravity or a total weight when setting a ball spin characteristic.

Furthermore, since it is not necessary to change the thickness of the face portion 2, designing of a core used during molding can be simplified, and thickness accuracy can be increased. Also, inconveniences such as molten metal flow failure or the like can be avoided, and a good hitting sound can be maintained at the time of hitting a ball.

In the first to fourth examples, the depths of the plurality of grooves (score line) provided in the outer surface of the face portion are gradually changed in the vertical direction of the head. But the depths of the plurality of grooves provided in the outer surface of the face portion may be gradually changed in the toe and heel direction of the head as in the case of the fifth to eighth examples. Also, in the fifth to eighth examples, the depths of the plurality of grooves provided in the inner surface of the face portion are gradually changed in the toe and heel direction of the head. But the depths of the plurality of grooves provided in the inner surface of the face portion may be gradually changed in the vertical direction of the head as in the case of the first to fourth examples.

EXAMPLE

The inventors manufactured a golf club head according to each of the first to fourth examples shown in FIGS. 1 to 4. This golf club head includes a plurality of score lines provided in an outer surface of a face portion, and depths of the score lines are gradually changed. The inventors manufactured a golf club head according to each of the fifth to eighth examples shown in FIGS. 5 to 8. This golf club head includes a plurality of score lines provided in an outer surface of a face portion, and depths of the score lines are kept constant. The golf club head also includes a plurality of grooves provided in an inner surface of the face portion, and depths of the grooves are gradually changed. The inventors also manufactured a conventional golf club head. This golf club head includes a plurality of score lines provided in an outer surface of a face portion, and depths of the score lines are kept constant.

In the first to fourth examples, depths of the score lines were set to 0.1 mm at the minimum and 1.0 mm at the maximum.

In the fifth to eighth examples, depths of the score lines were set to 0.5 mm. Depths of the grooves provided in the inner surface of the face portion were set to 0.1 mm at the minimum and 1.5 mm at the maximum.

In the conventional example, depths of the score lines were set to 0.5 mm. A thickness of the face portion was set to 3.0 mm for all the cases.

Under the following test conditions, the golf club heads of the first to eighth examples and the conventional example were fixed to golf club shafts, and a swing robot was used to hit balls at a head speed of 40 m/s by varying hitting point positions. Then, quantities of spin were measured immediately after the balls were hit. The results of the measurement are shown in Table 1.

Test conditions

Swing robot: Swing robot by Miyamae

Ball: Two-piece ball (DATALONG by PRGR)

Golf club: Titanium wood club (loft angle 10°)

Figure 9:
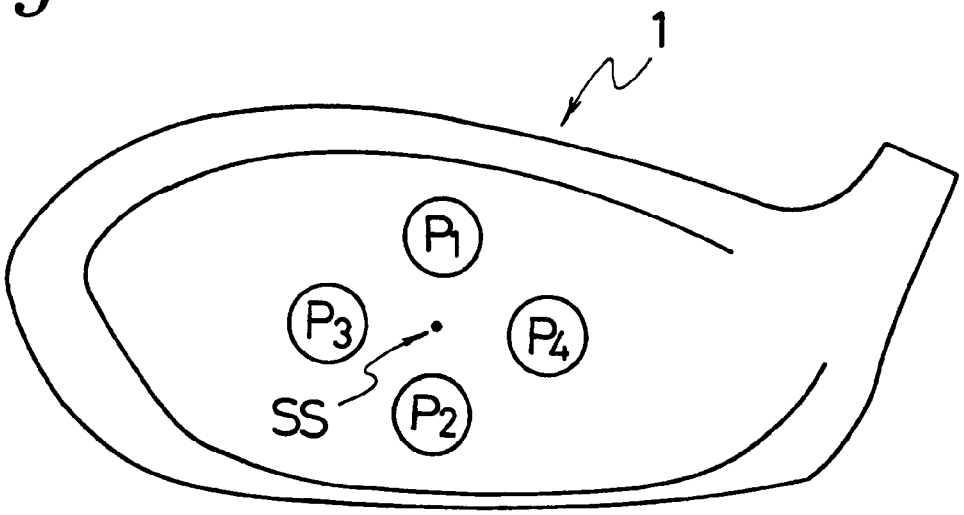
FIG. 9 is a front view showing hitting positions of the respective golf club heads of the examples.

The quantity of spin was measured ten times for each golf club head to obtain an average value. The quantity of spin is a rotational speed (rpm) per minute, and represented by a 100 rpm unit by rounding off tens. The hitting point positions ($P_1$ to $P_4$) are as shown in FIG. 9. But the hitting point positions $P_1$ to $P_4$ in FIG. 9 may be slightly different from actual hitting positions, since these positions are drawn to clarify relative positional relations to a sweet spot SS. For the position $P_1$ of the head upper portion and the position $P_2$ of the head lower portion, the quantities of backspin are indicated by + values; for the position $P_3$ of the head toe portion, the quantity of hook spin is indicated by a + value; and for the position $P_4$ of the head heel portion, the quantity of slice spin is indicated by a − value. In other words, a hook tendency is increased as a + value of sidespin is larger. A slice tendency is increased as a − value is larger. Together with an actually measured value, the quantity of spin in each hitting point position is represented by an index with the quantity of spin in the same hitting point position of the conventional example set to 100. The quantity of spin is larger as an index value is larger.

TABLE 1

| | Quantity of spin (rpm/index) | | | |
|---|---|---|---|---|
| | Hitting point position $P_1$ | Hitting point position $P_2$ | Hitting point position $P_3$ | Hitting point position $P_4$ |
| Conventional | 2400/100 | 3200/100 | 500/100 | −500/100 |
| Example 1 (FIG. 1) | 2700/113 | 3500/109 | — | — |
| Example 2 (FIG. 2) | 2100/88 | 2900/91 | — | — |
| Example 3 (FIG. 3) | 2700/113 | 2900/91 | — | — |
| Example 4 (FIG. 4) | 2100/88 | 3500/109 | — | — |
| Example 5 (FIG. 5) | — | — | 200/40 | −800/160 |
| Example 6 (FIG. 6) | — | — | 800/160 | −200/40 |
| Example 7 (FIG. 7) | — | — | 800/160 | −800/160 |
| Example 8 (FIG. 8) | — | — | 200/40 | −200/40 |

It can be understood from Table 1 that in each of the golf club heads of the first to eighth examples, it was possible to set an optional spin characteristic of a ball by gradually changing the groove depths according to the position of the face portion.

What is claimed is:

1. A golf club head comprising:

a hollow structure having a face portion constituting a ball hitting face, an upper crown portion and a lower sole portion, said upper crown portion and said lower sole portion extending in a rearward direction from an upper and lower end respectively of said face portion, a toe portion adjacent one side of said face portion and heel portion adjacent an opposite side thereof, and a plurality of grooves in the face portion, each of the plurality of grooves extending in a direction between said heel and toe portions and the depths of the plurality of grooves gradually changing in a direction extending between said toe and heel portions of the head, and wherein the face portion includes a part having a lower rigidity where the grooves are of a greater depth.

2. The golf club head of claim 1, wherein the grooves are on an inner surface of the face portion and the depths of the plurality of grooves gradually increase in a direction extending from said toe portion to said heel portion.

3. The golf club head of claim 1, wherein the grooves are on an inner surface of the face portion and the depths of the plurality of grooves gradually increase in a direction extending from said heel portion to said toe portion.

4. The golf club head of claim 1, wherein the grooves are on an inner surface of the face portion and the depths of the plurality of grooves gradually increase from a center of the face portion toward both the heel and toe portions.

5. The golf club head of claim 1, wherein the grooves are on an inner surface of the face portion and the depths of the plurality of grooves gradually increase from both the toe and heel portions toward a center of the face portion.

6. A golf club head comprising:

a hollow structure having a face portion constituting a ball hitting face, an upper crown portion and a lower sole portion, said upper crown portion and said lower sole portion extending in a rearward direction from an upper and lower end respectively of said face portion, a toe portion adjacent one side of said face portion and heel portion adjacent an opposite side thereof, and a plurality of grooves forming score lines on an outer surface of the face portion, the plurality of grooves extending in a direction between said toe and heel portions and the depths of the plurality of grooves gradually increasing in a direction extending from the lower sole portion to the upper crown portion, and wherein the face portion includes a part having a lower rigidity where the grooves are of a greater depth.

7. A golf club head comprising:

a hollow structure having a face portion constituting a ball hitting face, an upper crown portion and a lower sole portion, said upper crown portion and said lower sole portion extending in a rearward direction from an upper and lower end respectively of said face portion, a toe portion adjacent one side of said face portion and heel portion adjacent an opposite side thereof, and a plurality of grooves forming score lines on an outer surface of the face portion, the plurality of grooves extending in a direction between said toe and heel portions and the depths of the plurality of grooves gradually increasing in a direction from a center of the face portion toward both the upper crown portion and the lower sole portion of the head, and wherein the face portion includes a part having a lower rigidity where the grooves are of a greater depth.

* * * * *